US005701615A

United States Patent [19]

Baker

[11] Patent Number: 5,701,615

[45] Date of Patent: Dec. 30, 1997

[54] SPLASH GUARD FOR USE WHEN BATHING CHILDREN

[76] Inventor: Michelle R. Baker, 304 Nottaway Dr., Madison Heights, Va. 24572

[21] Appl. No.: 740,267

[22] Filed: Oct. 25, 1996

[51] Int. Cl.[6] ..... A47K 3/034; A47K 3/12

[52] U.S. Cl. ..... 4/559; 4/572.1

[58] Field of Search ..... 4/559, 572.1, 571.1, 4/586, 639, 640, 641, 642, 659, 609, 656, 637, 658, 630

[56] References Cited

U.S. PATENT DOCUMENTS

| | | | |
|---|---|---|---|
| 1,462,178 | 7/1923 | Muir | 4/637 |
| 3,444,564 | 5/1969 | Lavacchia | 4/559 |
| 3,965,496 | 6/1976 | Grelle | 4/572.1 |
| 3,984,880 | 10/1976 | Schrameyer | 4/146 |
| 4,025,970 | 5/1977 | Robust | 4/173 |
| 4,189,790 | 2/1980 | Masters | 4/149 |
| 4,369,532 | 1/1983 | Houchins et al. | 4/630 |
| 4,480,343 | 11/1984 | Drach | 4/637 |
| 4,491,990 | 1/1985 | Robinson et al. | 4/607 |
| 4,620,332 | 11/1986 | Laird | 4/559 |
| 4,765,001 | 8/1988 | Smith | 4/609 |
| 4,878,257 | 11/1989 | Hardin | 4/658 |
| 4,888,835 | 12/1989 | Baumann | 4/609 |
| 4,891,850 | 1/1990 | Borstcher | 4/609 |
| 4,944,050 | 7/1990 | Shames et al. | 4/609 |
| 5,123,129 | 6/1992 | Lyons | 4/557 |
| 5,231,707 | 8/1993 | Ashley et al. | 4/557 |
| 5,274,859 | 1/1994 | Redman et al. | 4/608 |
| 5,365,619 | 11/1994 | Solomon | 4/609 |
| 5,381,564 | 1/1995 | Carroll | 4/559 |

FOREIGN PATENT DOCUMENTS

| | | | |
|---|---|---|---|
| 1236955 | 6/1960 | France | 4/572.1 |
| 5-64618 | 3/1993 | Japan | 4/657 |
| 360473 | 4/1962 | Switzerland | 4/572.1 |
| 2506 | 5/1911 | United Kingdom | 4/637 |

*Primary Examiner*—Henry J. Recla
*Assistant Examiner*—Charles R. Eloshway
*Attorney, Agent, or Firm*—Scott C. Fegan

[57] ABSTRACT

A splash guard for a bathtub which is used when bathing children. The device comprises a bathing module, which sits on the bathtub long edge and provides a play area which will accommodate a variety of toys, and a storage module which is located at one end of the bathtub. The bathing module and storage module fit together for storage.

4 Claims, 9 Drawing Sheets

SPLASH GUARD FOR USE WHEN BATHING CHILDREN

BACKGROUND OF THE INVENTION

The present invention is a device to prevent water splashing out of a bathtub while providing an environment for childrens' play activities while being bathed.

Parents are familiar with the problem of keeping the floor near the bathtub reasonably dry when bathing small children. A child's bath has become a period of recreation with toys and games, all of which make splashing water all the more likely. Unless provision is made to prevent it, a significant amount of water may collect on the rim of the bathtub and/or run down the side of the tub or be splashed over the bathtub rim; wetting the floor.

In addition, such a splash guard should not interfere with adults taking baths or showers by restricting access to the bathtub; so such a device should have provision for storage in an appropriate location.

For the foregoing reasons, there is a need for a device which prevents water from splashing out on to the floor, and provides a play environment and a place to play with toys.

OBJECTS OF THE INVENTION

Accordingly, one object of the present invention is to prevent water splashing out of a bathtub while a child is being bathed.

Another object of the present invention is to provide a place for children to put toys and other objects while bathing.

An additional object of the present invention is to provide a convenient place in the bathroom for toys to be stored between bathings.

Yet another object of the present invention is to provide a play area capable of having more than one environment.

Still another object of the present invention is to provide a splash guard for bathtubs which can be easily installed for use, and easily stored at the end of the bathtub while not in use.

Yet still another object of the present invention is to provide a splash guard which does not restrict a parent's access to the child while the child is being bathed.

An additional object of the present invention is to provide a splash guard for use while bathing children which is supported by the bathtub rim and is not dependent on the bathtub having an enclosure. These together with other objects and advantages which will become apparent reside in the details of construction and operation as more fully hereinafter described and claimed, reference being made to the accompanying drawings forming a part hereof, wherein like numerals refer to like parts throughout.

SUMMARY OF THE INVENTION

My invention achieves the above stated objects as well as other advantages described herein, by means of a splash guard.

My splash guard for a bathtub, comprises a bathing module and a storage module. The bathing module has a bottom surface having an inner edge, an outer edge, and 2 side edges, and has a back having an upper edge, a lower edge, and two side edges, connected at the lower edge proximate the outer edge of the bottom surface, the back extending substantially upward.

It also has a first side and a second side, each having an upper edge, a lower edge, two side edges, and an inner surface and an outer surface, each connected proximate its lower edge to one of the side edges of the bottom surface, the first side and second side each connected at one of the side edges to a side edge of the back, and the first and second sides extending substantially upward.

The bathing module also has a lip, having a first long edge, a second long edge, and two side edges, and the lip is connected at the first long edge to the inner edge of the bottom surface, the lip extending substantially downward proximate the inner surface of the bathtub, The bathing module also has a seating surface attached to the bottom surface, Included is a drainage shelf with an array of holes for water drainage, connected to the back and the first and second sides by sliding into a groove incorporated into the back and the first and second sides.

The bottom surface is slanted downwards from the outer edge to the inner edge, so any water on the bottom surface will drain into the bathtub.

The bottom surface, the back, and the inner surfaces of the first and second sides define a partially enclosed space which traps water during bathing.

My invention also includes a storage module having, a bottom surface having an inner edge, an outer edge, and 2 side edges, a back having an upper edge, a lower edge, and two side edges, connected at said lower edge proximate the outer edge of the bottom surface, the back extending substantially upward.

The storage module also has a first side and a second side, each having an upper edge, a lower edge, two side edges, and an inner surface and an outer surface, each connected proximate its lower edge to one of the side edges of the bottom surface. The first side and second side each are connected at one of the side edges to a side edge of the back, said first and second sides extending substantially upward.

The storage module also has an extension member attached proximate the bottom edge of each of the first and second sides of the storage module, and these extension members extend substantially outward from the lower portion of each of the first and second sides of the storage module.

The bottom surface has an array of holes for water drainage.

Whereby said bottom surface, said back, and said inner surfaces of said first and second sides define a partially enclosed space.

DESCRIPTION OF THE DRAWINGS

My invention will be better understood and objects other than above will become apparent when consideration is given to the following detailed description thereof. Such description makes reference to the annexed drawings wherein.

DESCRIPTION

Figure 1:
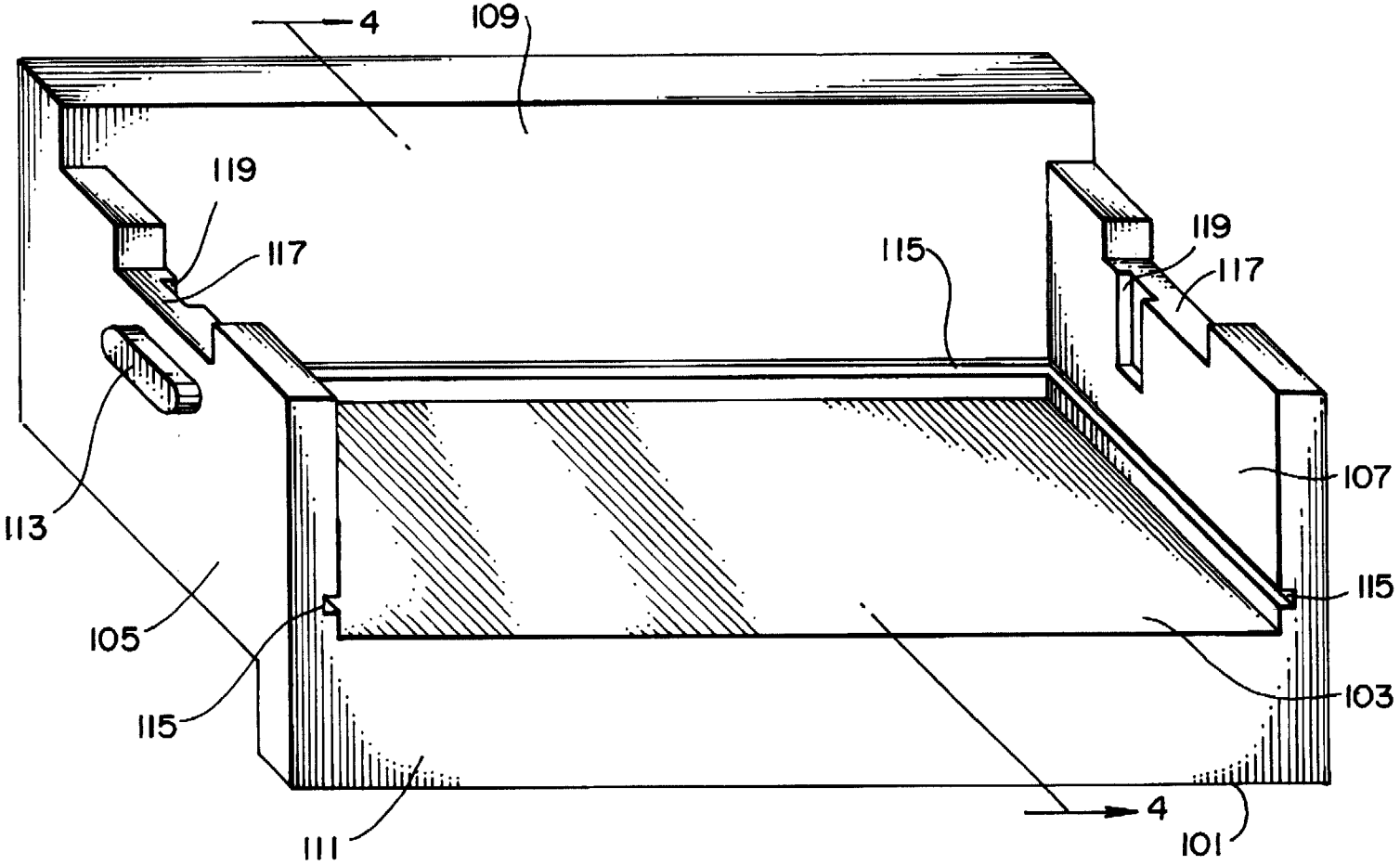
FIG. 1 is a isometric view of the Bathing Module.
Figure 2:
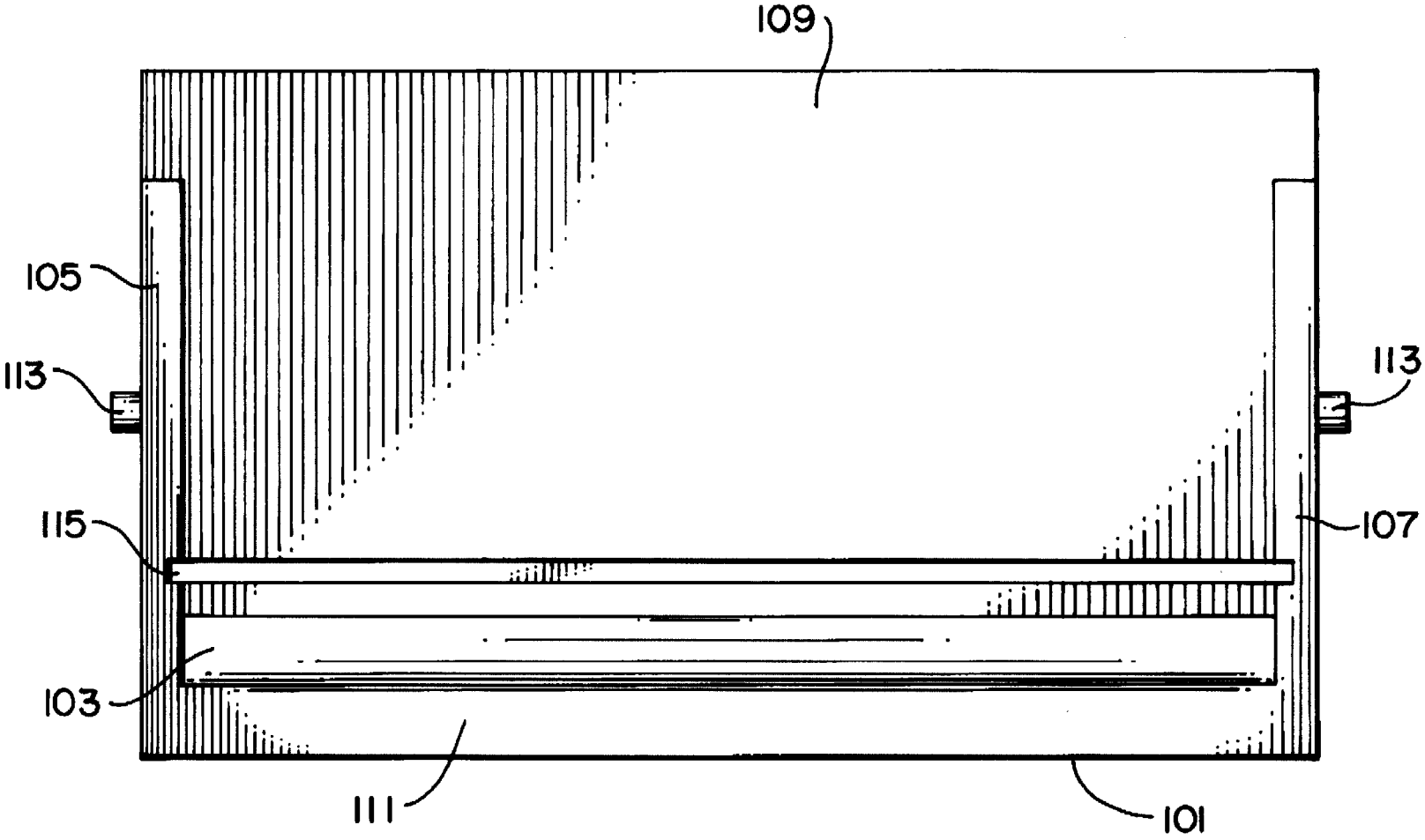
FIG. 2 is a front view of the Bathing Module.
Figure 3:
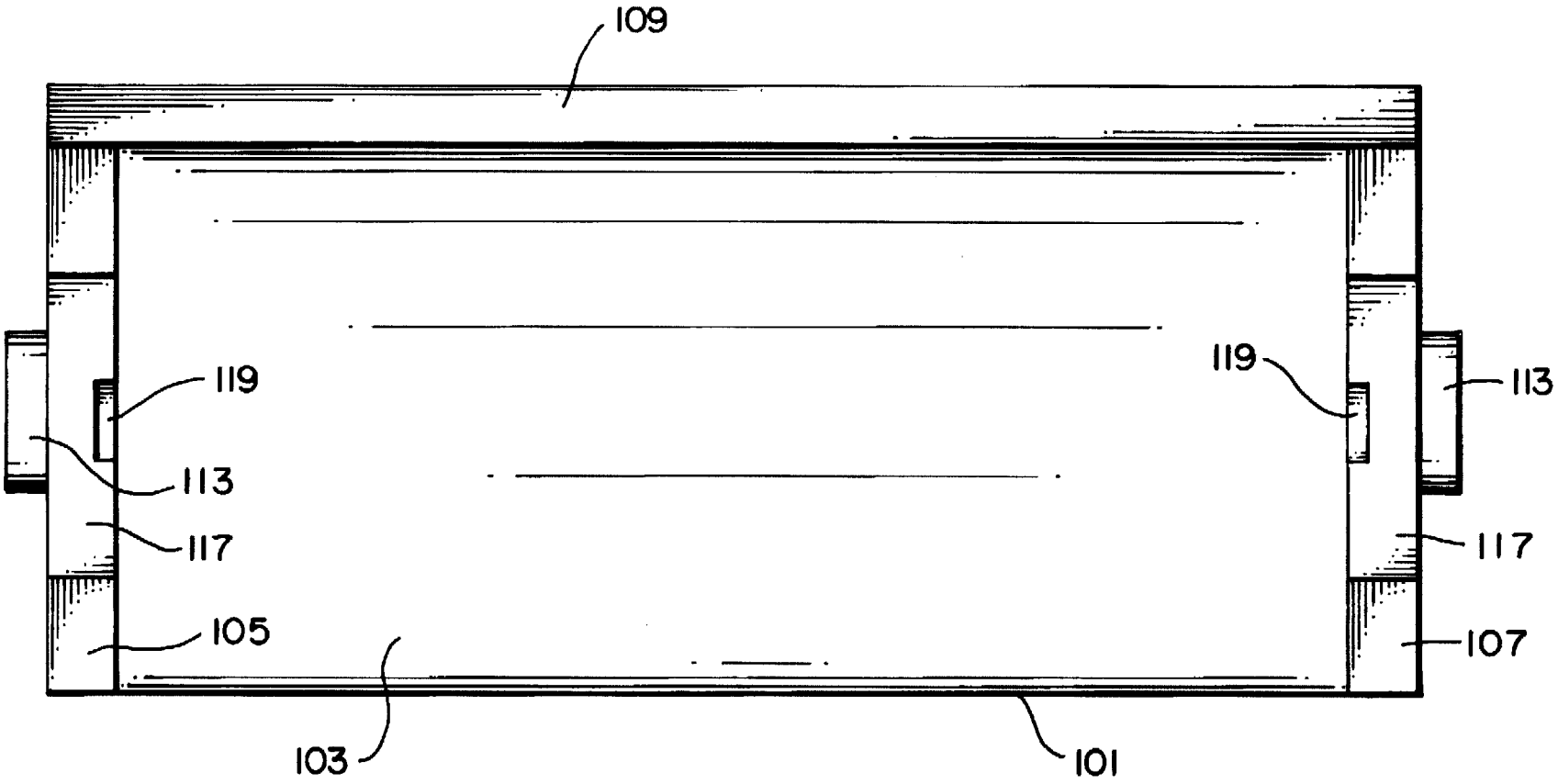
FIG. 3 is a top view of the Bathing Module.

With reference now to the drawings, and in particular to FIGS. 1–9 thereof, a new splash guard for use in bathing children embodying the principles and concepts of the present invention and generally designated by reference numerals 101, 201 and 301 will now be described.

Bathing Module 101 is shown in FIG. 1, and has a bottom surface 103, a first side 105 and a second side 107, and a back 109. First and second sides 105 and 107 are located at the side edges of the bottom surface 103 and extend upwards from it. Back 109 is located at the outer edge of bottom surface 103 and extends upwards from it, and back 109 contacts first and second sides 105 and 107. Bottom surface 103, first side 105, second side 107, and back 109 define a partially enclosed space which traps water during bathing. Lip 111 extends downwards from the inner edge of bottom surface 103. Bottom surface 103 is slanted downwards from the outer edge to the inner edge, so any water on the bottom surface 103 will drain into the bathtub.

The Bathing Module 101 is designed to sit on the bathtub edge with lip extending down the inside of the bathtub wall.

The outer surfaces of first side 105 and second side 107 each have a handle 113 which are used to manipulate the Bathing Module 101, as when putting it in place on the bathtub wall, or when removing the Bathing Module 101 from the bathtub wall after bathing is done.

The inner surface of first side 105, second side 107, and back 109 all face inward and each has a groove 115. Groove 115 is located and sized such that it can receive drainage shelf 301, shown in FIG. 9. In the most preferred embodiment drainage shelf 301 has a regularly spaced array of holes 303 through which water drains onto the bottom surface 103 and which also act as positioning devices for toys such as animal or people characters, toy buildings or cars, or other toys. These toys would fit into the holes 303. Of course, it is not necessary to use specially made toys with this invention. Any type of toy or toys which sit on a generally horizontal surface can be used, since drainage shelf 301 is substantially horizontal.

First side 105 and second side 107 each have a recess 117 at the top. This recess is used when the Bathing Module is stored as described below.

The inner surface of first side 105, and second side 107 both have a slot 119 extending downward from the top. These slots are also used when the Bathing Module is stored as described below.

Figure 4:
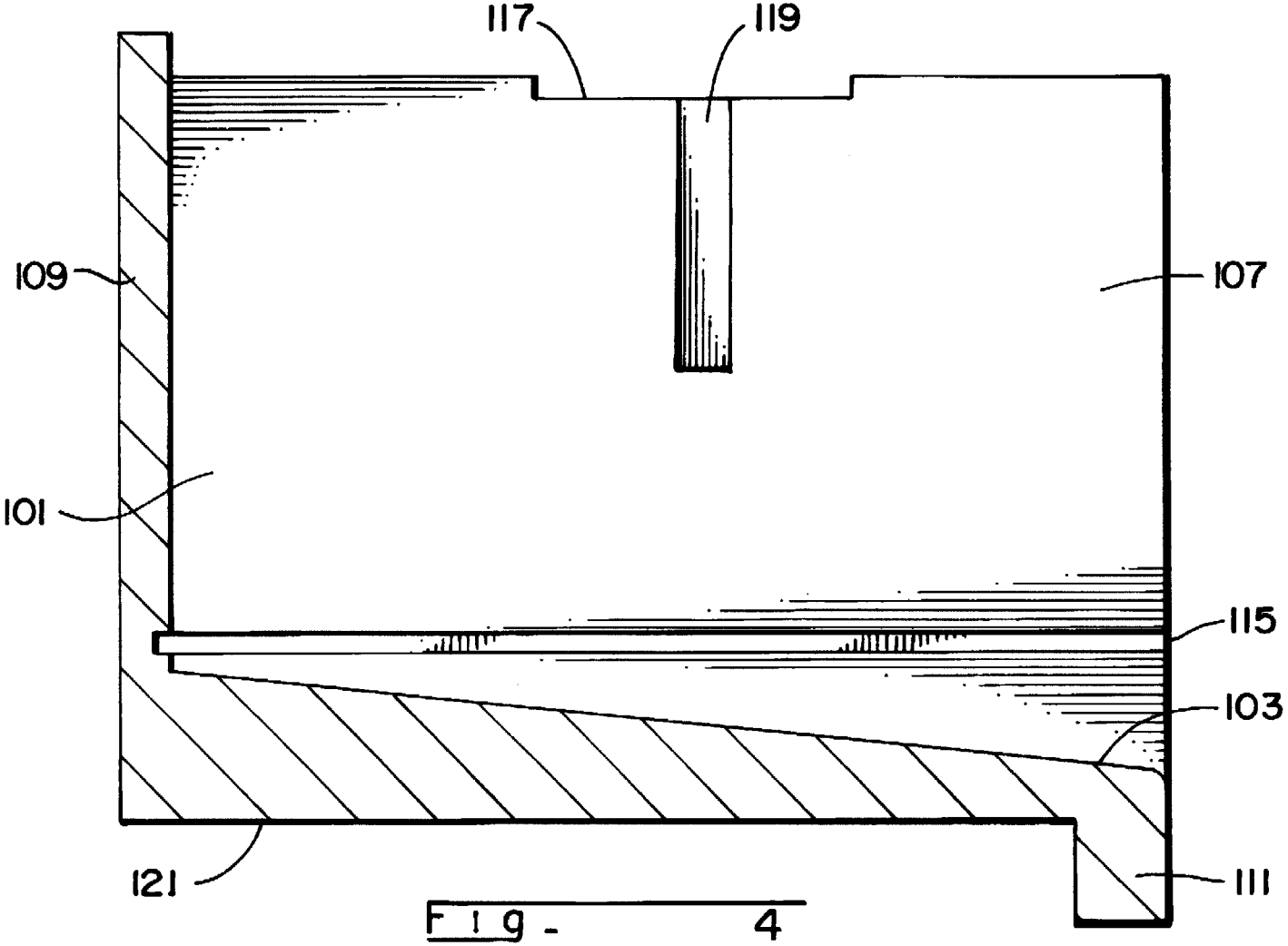
FIG. 4 is a cross sectional view taken along the lines of 4—4 of FIG. 1 in the direction indicated by the arrows.

Seating surface 121 and bottom surface 103 are not parallel, but rather bottom surface 103 is angled downward from back to front to allow water to drain into the bathtub; this angular arrangement is shown in FIG. 4 and other Figures. The angle between seating surface 121 and bottom surface 103 is not critical; bottom surface 103 need only be angled enough to facilitate water drainage. Any angle within the range of 5 to 10 degrees works very well. Other angles, greater than or less than the range 5 to 10 degrees, will also work.

Figure 5:
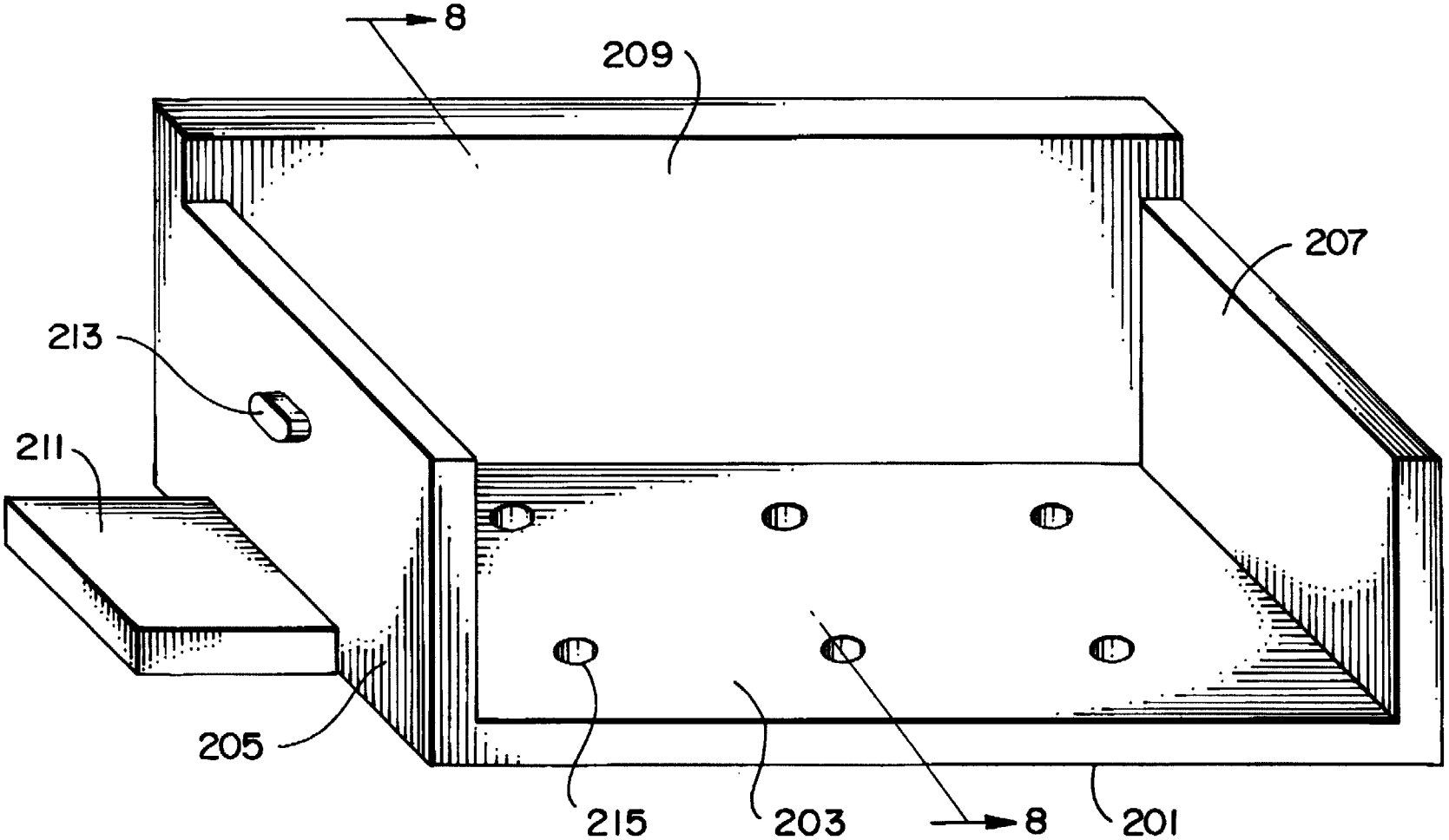
FIG. 5 is a isometric view of the Storage Module.
Figure 6:
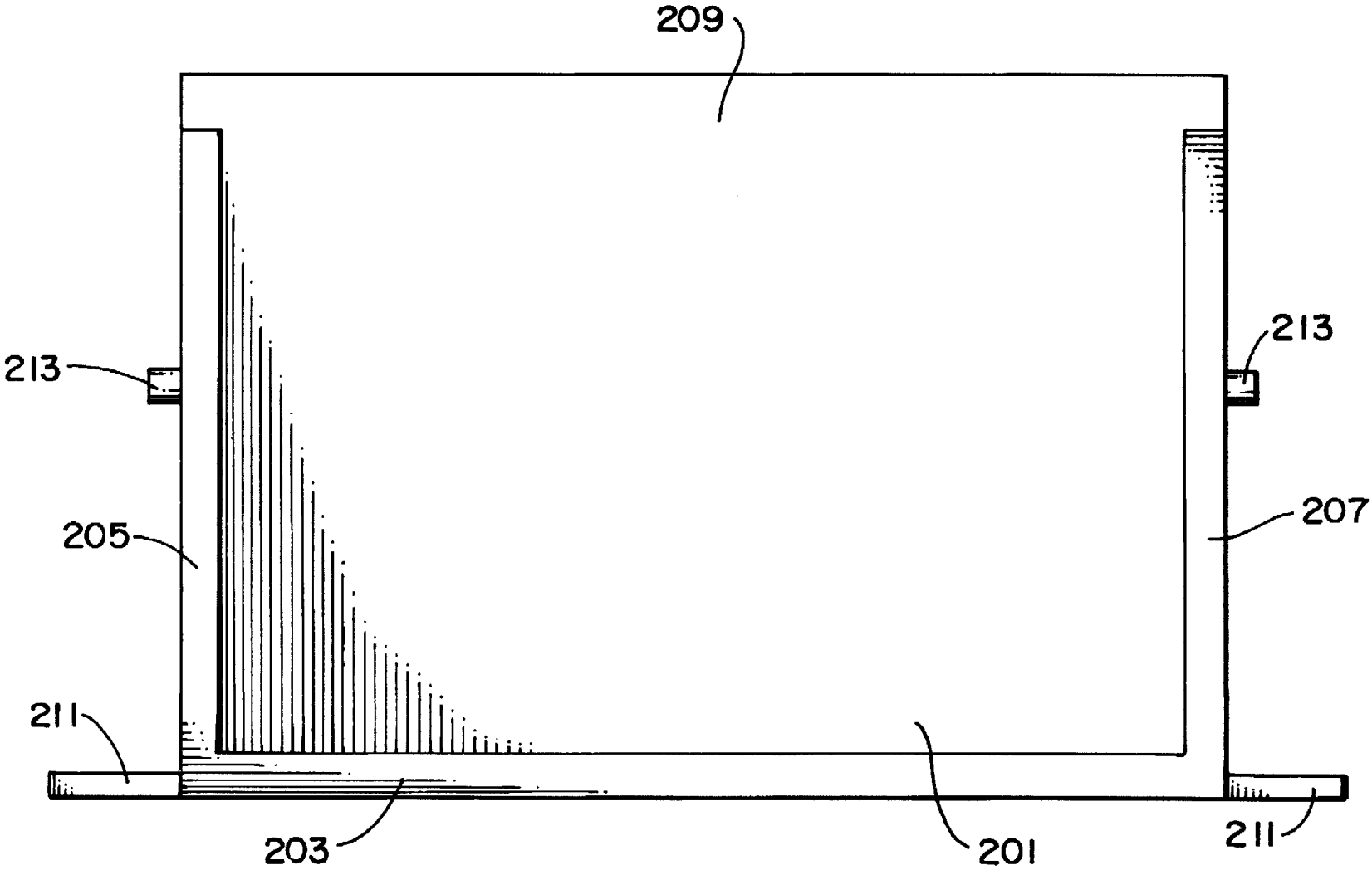
FIG. 6 is a front view of the Storage Module.
Figure 7:
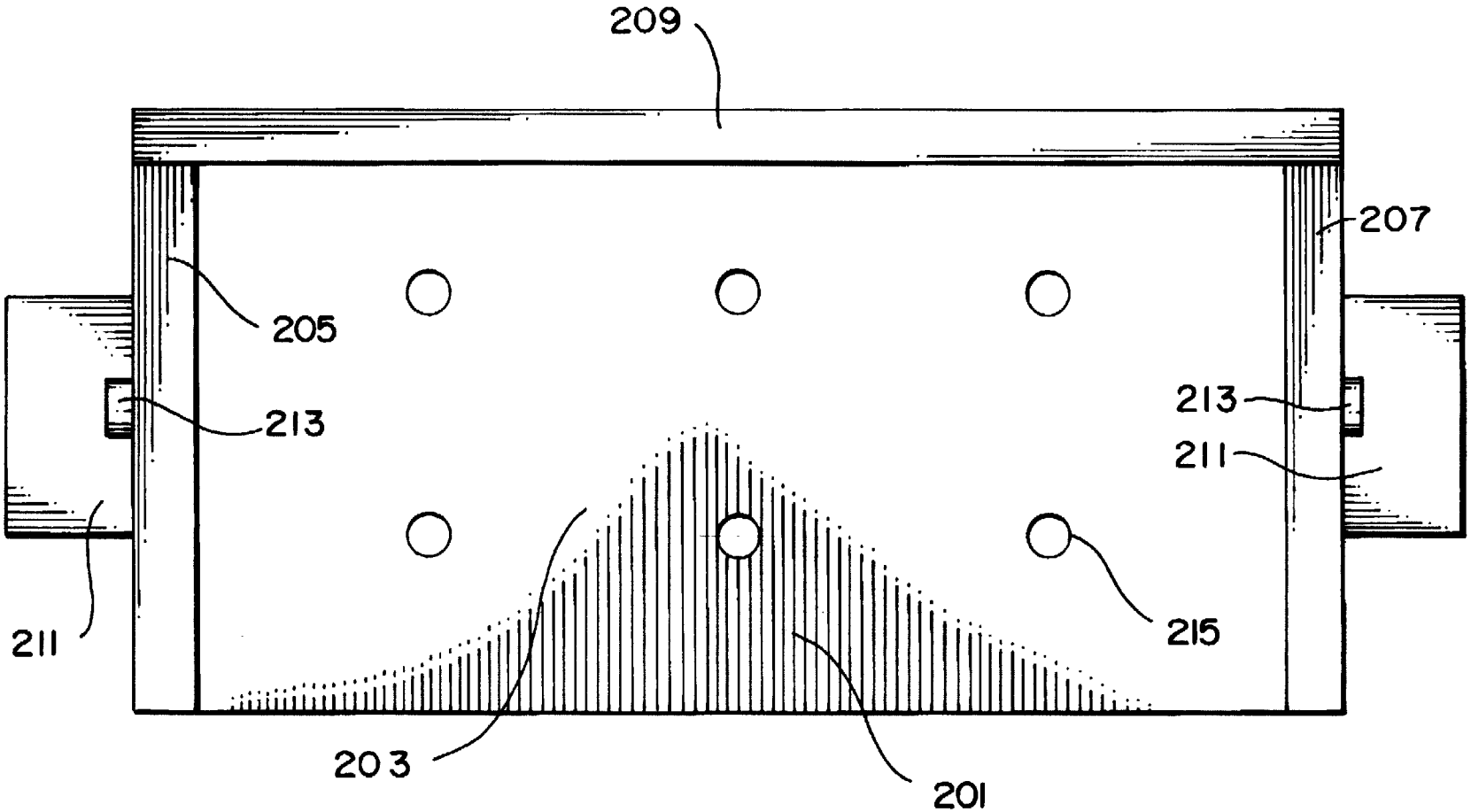
FIG. 7 is a top view of the Storage Module.
Figure 8:
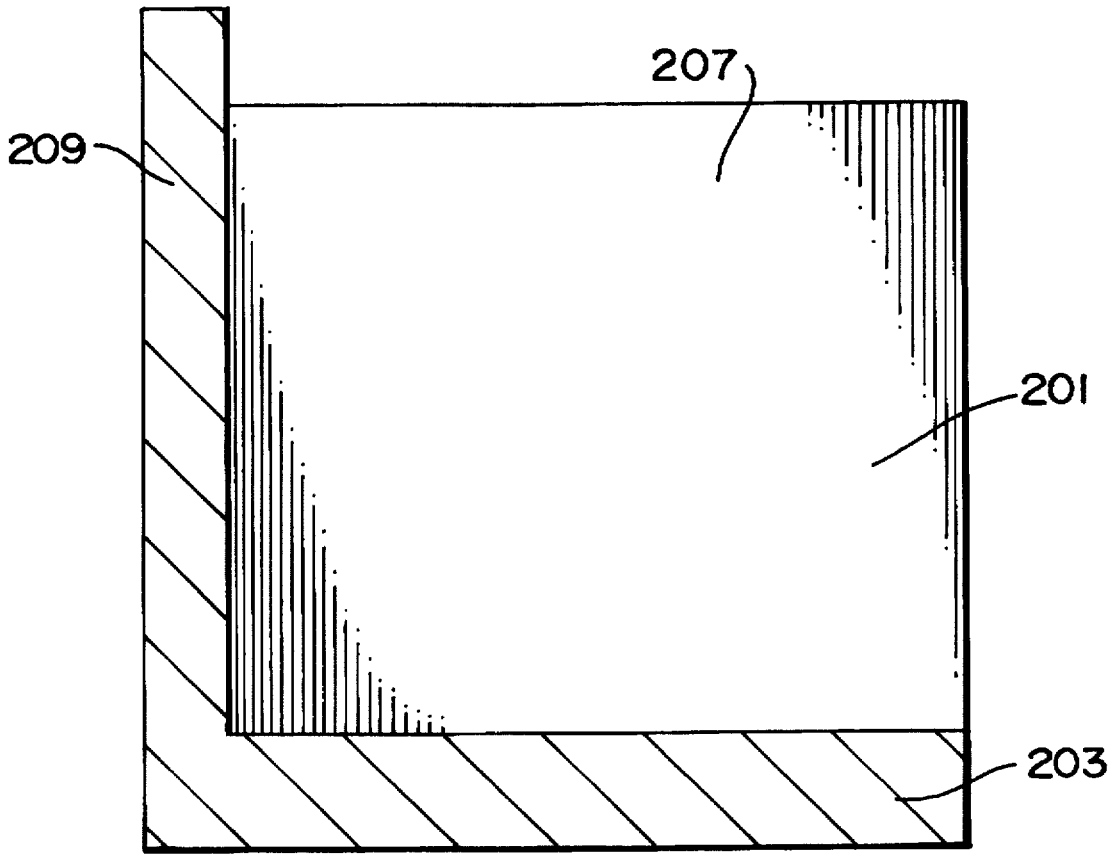
FIG. 8 is a cross sectional view taken along the lines of 8—8 of FIG. 5 in the direction shown by the arrows.
Figure 9:
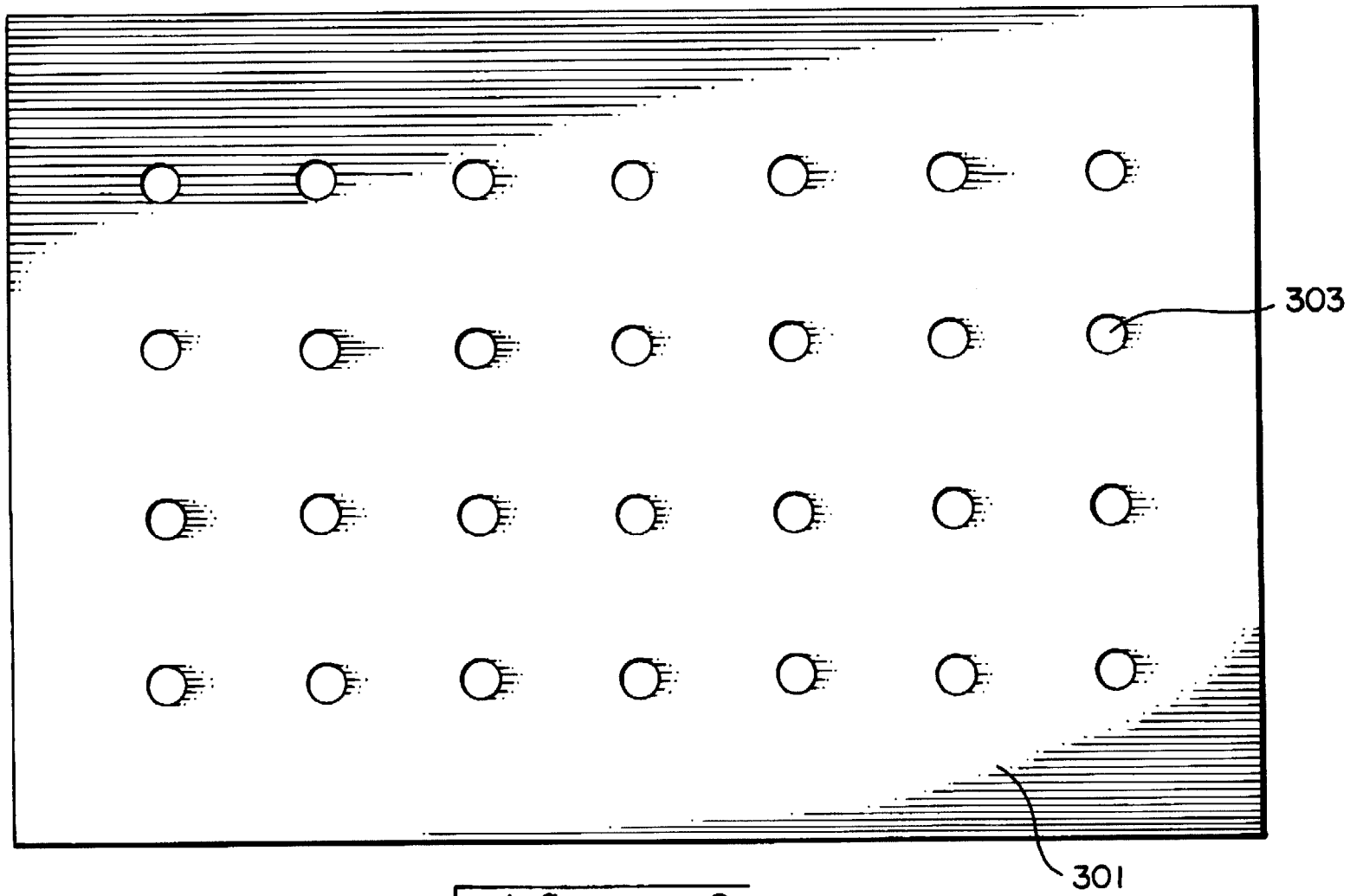
FIG. 9 is a view of the drainage shelf.

Storage Module 201 is shown in FIG. 5, and has a bottom surface 203, a first side 205 and a second side 207, and a back 209. First and second sides 205 and 207 are located at the side edges of the bottom surface 203 and extend upwards from it. Back 209 is located at the outer edge of bottom surface 203 and extends upwards from it, and back 209 contacts first and second sides 205 and 207. Bottom surface 203, first side 205, second side 207, and back 209 define a partially enclosed space. Bottom surface 203 has an array of holes 215 for drainage, so any water on the bottom surface 203 will drain into the bathtub.

First side 205 and second side 207 each have an extension member 211 which extends outward from the lower portion of each side. Storage module 201 is normally located at one end of the bathtub, with extension members 211 resting on the bathtub sides so that storage module 201 lies across the end of the bathtub.

First side 205 and second side 207 each have a knob 213 which extends outward. Knobs 213 are sized and located so that when the bathing module 101 is turned upside down by rotating on the axis formed by handles 113 and lowered over storage module 201, knobs 213 fit into slots 119. Bathing module 101 is sized such that when it is rotated as previously described and lowered over storage module 201, knobs 213 fit into slots 119 and extension members 211 fit into recesses 117. This is accomplished by making the dimension between inner surfaces of first and second sides 105 and 107 of bathing module 101 somewhat larger than the dimension between the outer surfaces of first and second sides 205 and 207 of storage module 201. The invention is normally stored in this manner, at the end of the bathtub and out of the way of adults using the bathtub. The previously mentioned toys can be placed on bottom surface 203 and conveniently stored therein.

Bottom surface 203 has a series of holes 215 for drainage. Any water remaining on toys stored on bottom surface 203 will readily drain into the bathtub, reducing water accumulation and allowing the toys to dry between bathing episodes. This reduces mildew formation without requiring toys to be dried manually before being stored.

Of course, bottom surface 203 need not have a regularly spaced array of circular holes; the array of holes may be irregular, or oval holes or even elongated slots may be used instead of circular holes, or any combination of these that will provide for water drainage may be used.

Also, the surface of the drainage shelf 301 can include play environments such as a stove top, sink, holders for play dishes, a racetrack for toy cars, a battlefield, playgrounds such as swing sets or slides, playhouses, pool sets, or other play environments as are well known in the childrens toy art. These environments may be separate or permanently mounted. The drainage shelf 301 may have recessed compartments in its surface for holding soap or other bathing objects.

The drainage shelf 301 may fit onto the Bathing Module 101 by means other than the groove 115 on the back 109 and sides 105 and 107. The back 109 and sides 105 and 107 of the Bathing Module 101 may be provided with mounting brackets, for example, and the drainage shelf 301 would then be provided with prongs which fit into the brackets. Although a removable drainage shelf is preferred over a permanently attached drainage shelf to facilitate cleaning, and to allow the use of several different drainage shelves with different play environments for example, a removable drainage shelf is not absolutely necessary; it can be permanently attached.

The back, first side, and second side of both the Bathing Module and the Storage Module could be somewhat higher or lower than shown, depending on particular design features of a specific embodiment.

The parts can be made from any inexpensive material such as: wood to which a water-protective coating like varnish has been applied; rubber material; a variety of moldable plastics; plastic sheet material cut to size and assembled; acrylic or reinforced acrylic resin; gel coat fiberglass; polystyrene; polyethylene; polyvinyl chloride; or other materials according to toy making arts. If the material is synthetic, the various parts may be transparent, translucent, or opaque in a variety of colors and patterns, in a manner well known in toy making and plastics arts.

It will be understood that the embodiments described above are, of course, to be regarded merely as non-limiting examples and that various changes in the details, materials and arrangement of parts and systems which have been herein described and illustrated in order to explain the nature of the invention may be made by those skilled in the art without departing from the true spirit of the present invention while being within the principle and scope of the invention as expressed in the appended claims.

I claim:

1. A splash guard for a bathtub, comprising:

a bathing module and a storage module, said bathing module, having a bottom surface having an inner edge, an outer edge, and two side edges;

a back having an upper edge, a lower edge, two side edges, an inner surface, and an outer surface, connected at said lower edge proximate the outer edge of the bottom surface, said back extending substantially upward, a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, a lip, having a first long edge, a second long edge, and two side edges, said lip connected at said first long edge to the inner edge of said bottom surface, said lip extending substantially downward, whereby said bottom surface, said back, and said inner surfaces of said first and second sides define a partially enclosed space which traps water during bathing;

said storage module having a bottom surface having an inner edge, an outer edge, and two side edges;

a back having an upper edge, a lower edge, and two side edges, connected at said lower edge proximate the outer edge of the bottom surface, said back extending substantially upward, a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, said bottom surface having water drainage means, whereby said bottom surface, said back, and said inner surfaces of said first and second sides define a partially enclosed space; and an extension member attached proximate the lower edge of each of said first and second sides of said storage module, said extension members extending substantially outward from the lower portion of each of said first and second sides of said storage module.

2. A splash guard for a bathtub as claimed in claim 1, wherein;

said first and second sides of said bathing module each have a recess, located at said upper edges, and each have a slot extending down said inner surfaces of said first and second sides from said upper edge of said first and said second sides, and said first and second sides of said storage module each have a knob attached to said outer surfaces.

3. A splash guard for a bathtub, comprising:

a bathing module and a storage module, said bathing module, having a bottom surface having an inner edge, an outer edge, and two side edges, having a back having an upper edge, a lower edge, and two side edges, connected at said lower edge proximate the outer edge of the bottom surface, said back extending substantially upward, having a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, having a handle fixedly attached to said first and second sides, having a lip, having a first long edge, a second long edge, and two side edges, said lip connected at said first long edge to the inner edge of said bottom surface, said lip extending substantially downward, having a seating surface connected to said bottom surface, having a drainage shelf with water drainage means, attached to said back and said first and second sides by attachment means;

said first and second sides of said bathing module each having a recess, located at said upper edges, and each having a slot extending down said inner surfaces of said first and second sides from said upper edge of said first and said second sides, where said bottom surface is slanted downwards from the outer edge to the inner edge, so any water on the bottom surface will drain into the bathtub, whereby said bottom surface, said back, and said inner surfaces of said first and second sides define a partially enclosed space which traps water during bathing;

said storage module having, a bottom surface having an inner edge, an outer edge, and two side edges;

a back having an upper edge, a lower edge, and two side edges, connected at said lower edge proximate the outer edge of the bottom surface, said back extending substantially upward, a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, having an extension member attached proximate the lower edge of each of said first and second sides of said storage module, said extension members extending substantially outward from the lower portion of each of said first and second sides of said storage module;

said bottom surface having water drainage means, said first and second sides of said storage module each having a knob attached to said outer surfaces, whereby said bottom surface, said back, and said inner surfaces of said first and second sides define a partially enclosed space.

4. A splash guard for a bathtub, comprising:

a bathing module and a storage module, said bathing module, having a bottom surface having an inner edge, an outer edge, and two side edges, having a back having an upper edge, a lower edge, and two side edges, connected at said lower edge proximate the outer edge of the bottom surface, said back extending substantially upward, having a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, having a lip, having a first long edge, a second long edge, and two side edges, said lip connected at said first long edge to the inner edge of said bottom surface, said lip extending substantially downward proximate the inner surface of the bathtub, having a seating surface connected to said bottom surface, having a drainage shelf with an array of holes for water drainage, attached to said back and said first and second sides by sliding into a groove incorporated into said back and said first and second sides;

where said bottom surface is slanted downwards from the outer edge to the inner edge, so any water on the bottom surface will drain into the bathtub, whereby said bottom surface, said back, and said inner surfaces of said first and second sides define a partially enclosed space which traps water during bathing;

said storage module having, a bottom surface having an inner edge, an outer edge, and two side edges;

a back having an upper edge, a lower edge, and two side edges, connected at said lower edge proximate the outer edge of the bottom surface, said back extending substantially upward, a first side and a second side, each having an upper edge, a lower edge, two side edges, and an inner surface and an outer surface, each connected proximate its lower edge to one of the side edges of the bottom surface, said first side and second side each connected at one of said side edges to a side edge of the back, said first and second sides extending substantially upward, having an extension member attached proximate the lower edge of each of said first and second sides of said storage module, said extension members extending substantially outward from the lower portion of each of said first and second sides of said storage module; and, said bottom surface having an array of holes for water drainage, whereby said bottom surface, said back, and said inner surfaces of said first and second sides define a partially enclosed space.

* * * * *